US005152596A

United States Patent [19]

Raleigh

[11] Patent Number: 5,152,596

[45] Date of Patent: Oct. 6, 1992

[54] ARTICULATE CABINET HINGES

[75] Inventor: William F. Raleigh, Santa Clarita, Calif.

[73] Assignee: Teledyne Industries, Inc., Los Angeles, Calif.

[21] Appl. No.: 601,886

[22] Filed: Oct. 23, 1990

[51] Int. Cl.[5] ..... A47B 88/00

[52] U.S. Cl. ..... 312/324; 49/255; 16/373

[58] Field of Search ..... 312/324, 311, 329; 49/255, 258, 261; 16/357, 359, 360, 363, 364, 373

[56] References Cited

U.S. PATENT DOCUMENTS

| | | | |
|---|---|---|---|
| 2,850,760 | 9/1958 | Vanderwalker | 16/360 |
| 2,951,611 | 9/1960 | Tillson et al. | 16/373 |
| 3,302,332 | 2/1967 | Malmrose et al. | 49/261 |
| 4,390,002 | 6/1983 | Daily | 16/373 |

*Primary Examiner*—Gerald A. Anderson

*Attorney, Agent, or Firm*—Benoit Law Corporation

[57] ABSTRACT

A hinge for a cabinet having a box and a door in an opening of that box, includes a hinge rod having a first offset end portion and a corresponding second offset end portion opposite that first offset end portion and an intermediate rod portion between these first and second offset end portions. A first mounting clip for the first offset end portion is connected either to the box or to the door near the cabinet opening. A second mounting clip for the second offst end portion is connected either to the box or to the door near the cabinet opening. At least one hinge rod mounting bracket for the intermediate rod portion is connected either to the door or to the box. A first slot for either the first offset end portion or for the intermediate rod portion is either in the first mounting clip or in the hinge rod mounting bracket, and a corresponding second slot for either the second offset end portion or for the intermediate rod portion is either in the second mounting clip or in the hinge rod mounting bracket.

32 Claims, 8 Drawing Sheets

ARTICULATE CABINET HINGES

BACKGROUND OF THE INVENTION

The subject invention relates to weatherproof and other cabinets for electrical or electronic controls and components or for other purposes, and relates also to cabinet hinges.

SUMMARY OF THE INVENTION

It is an object of this invention to provide an improved cabinet.

It is a related object of this invention to provide an improved hinge structure.

It is a germane object of this invention to provide improved environmental or weather protection of electrical, electronic and other delicate components in a cabinet.

It is a related object of this invention to provide a cabinet which both is weatherproof and has a hinged door that remains integral with the cabinet when the door is opened.

It is also an object of this invention to provide a hinged door construction in which the door is vertically moveable to a limited extent and is also swingable to open and shut positions.

Other objects will become apparent in the further course of this disclosure.

The subject invention resides in a cabinet having a box and a door in an opening of that box. From one aspect thereof, the invention resides in the improvement comprising, in combination, a hinge rod having a first offset end portion and a corresponding second offset end portion opposite that first offset end portion and an intermediate portion between these first and second offset end portions, a first mounting clip for the first offset end portion connected to one of the box and the door near said opening, a second mounting clip for the second offset end portion connected to that one of the box and the door near said opening (that is either to the box or to the door), a hinge rod mounting bracket for the intermediate rod portion connected to the other of the box and the door (that is either to the door or to the box, respectively), a first slot for one of the first offset end portion and the intermediate rod portion (that is either for the first offset end portion or for the intermediate rod portion) in one of the first mounting clip and the hinge rod mounting bracket, (that is either in the first mounting chip or in the hinge rod mounting bracket), and a corresponding second slot for one of the second offset end portion and the intermediate rod portion (that is for either the second offset end portion or for the intermediate rod portion) in a corresponding one of the second mounting clip and the hinge rod mounting bracket (that is either in the second mounting clip or again in the hinge rod mounting bracket).

According to the invention, the box has a downwardly projecting ledge along its opening at a right angle to the hinge rod, and the hinge rod has a free length at either of the first and second offset end portions corresponding to a height of that downwardly projecting ledge, whereby the door is selectively moveable away from the downwardly projecting ledge, and alternatively moveable upwardly and partially under that downwardly projecting ledge.

According to a related aspect thereof, the invention resides in the improvement comprising, in combination, a hinge rod having a first offset end portion and a corresponding second offset end portion opposite that first offset end portion, a first mounting clip for the first offset end portion connected to the box near the opening and having a first slot for that first offset end portion, a second mounting clip for the second offset end portion connected to the box near the opening and having a corresponding second slot for that second offset end portion, and a hinge rod mounting bracket inside of the first and second mounting clips connected to the door near the opening.

According to a related further aspect thereof, the invention resides in the improvement comprising, in combination, a hinge rod having a first offset end portion and a corresponding second offset end portion opposite that first offset end portion, a first mounting clip for the first offset end portion connected to the box near the opening, a second mounting clip for the second offset end portion connected to the box near the opening, and a hinge rod mounting bracket inside of the first and second mounting clips connected to the door and having a slot for said hinge rod.

The hinge rod including its first and second offset end portions and its intermediate portion therebetween are preferably located in one plane.

Other aspects of the invention provide variations of these combinations in which the mounting clips are connected either to the box or to the door, while the hinge rod mounting bracket is connected conversely either to the door or to the box, respectively.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
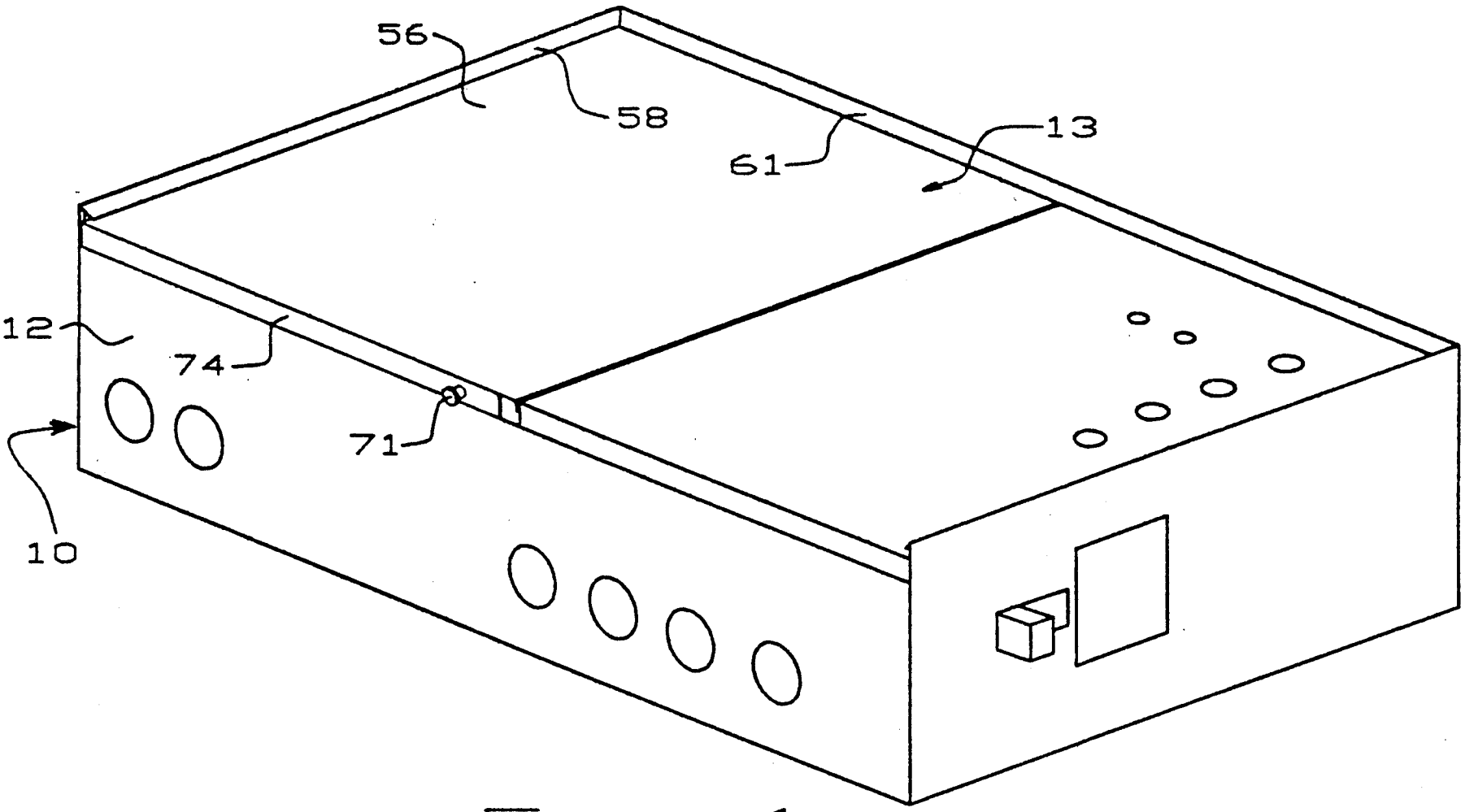
FIG. 1 is a perspective view of a cabinet according to an embodiment of the invention.
Figure 6:
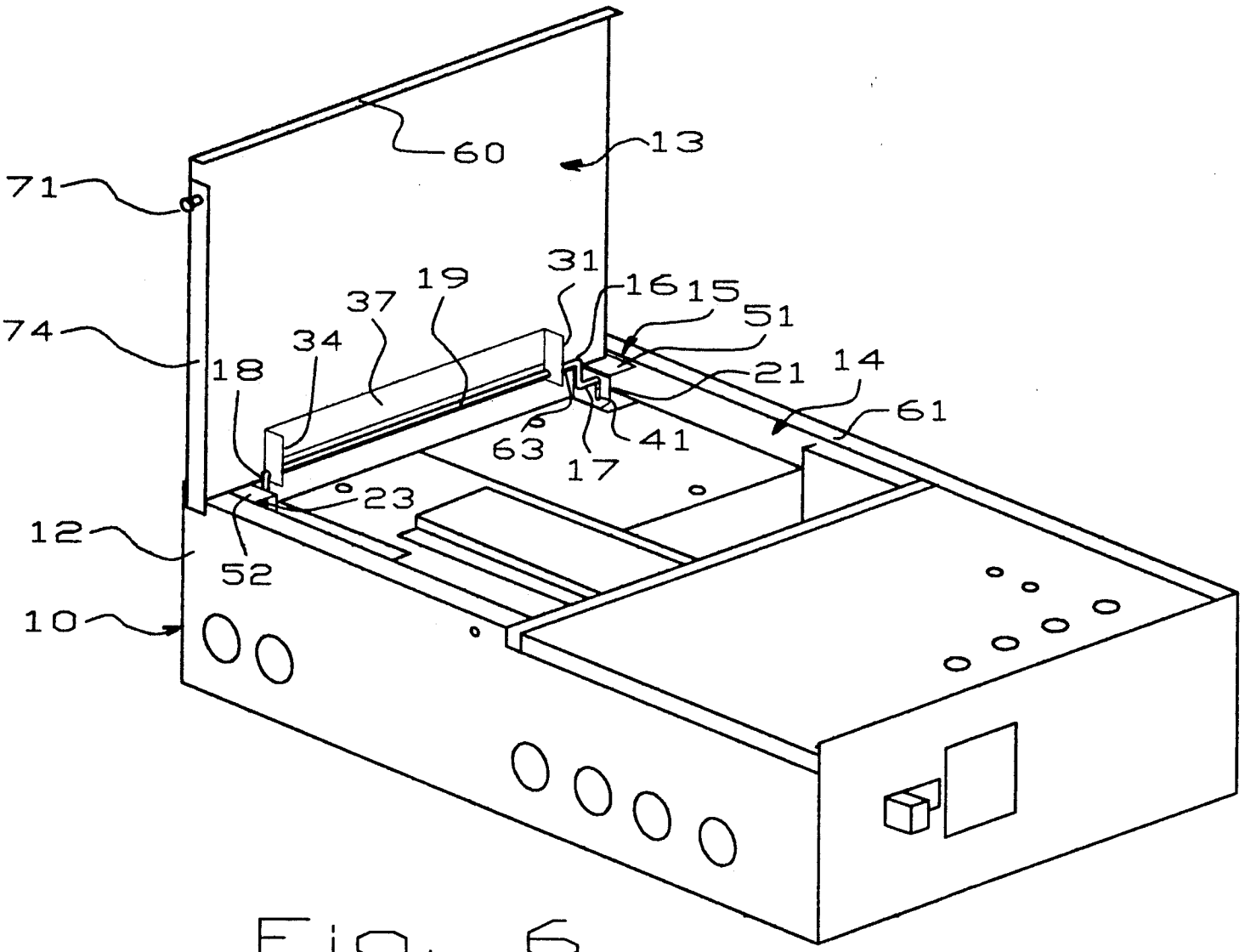
FIG. 6 is a perspective view of a cabinet, similar to FIGS. 1 and 2, according to a preferred embodiment of the invention.

While the invention is not limited to any particular kind of cabinet, the illustrated preferred embodiment of the invention is a weatherproof cabinet, particularly for electrical controls or components, as shown in FIGS. 1, 6, etc.

The illustrated cabinet 10 has a box 12 and a door 13 in an opening 14 of that box. As further shown in FIGS.

2 et seq. the cabinet 10 has a hinge 15 for the door 13, about which the door may be swung open and shut relative to the cabinet box 12 and opening 14 (see FIG. 6 et seq.). The cabinet 10 or hinge 15 has a hinge rod 16 having a first offset rod end portion 17 and a corresponding second offset rod end portion 18 opposite that first offset end portion, and an intermediate portion 19 between these first and second offset end portions. As apparent from the drawings, the hinge rod 16 including its first and second offset end portions 17 and 18 and its intermediate portion 19 is all in one plane. The hinge 15 also includes a first mounting clip 21 or 22 for the first offset rod end portion 17 connected to the box 12 or to the door 13, respectively, near the opening 14, and a second mounting clip 23 or 24 for the second offset rod end portion 18 connected to the box 12 or to the door 13, respectively, near the opening 14.

The hinge 15 further includes a first hinge rod mounting bracket 31 or 32 located inside of the first offset rod end portion 17 connected to the door 13 or to the box 12, respectively, near the cabinet opening 14, and a second hinge rod mounting bracket 34 or 35 located inside of the second offset rod end portion 18 and connected to the door 13 or to the box 12, respectively, near the cabinet opening 14.

Figure 2:
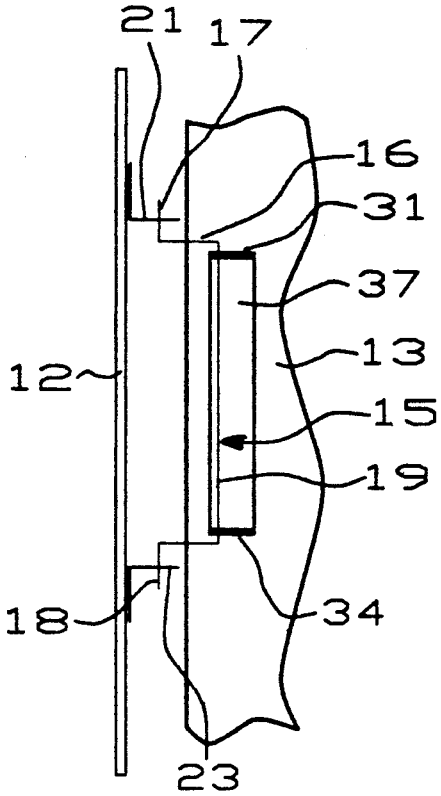
FIGS. 2 to 5 are diagrammatic views of various hinge structures according to embodiments of the invention.
Figure 4:
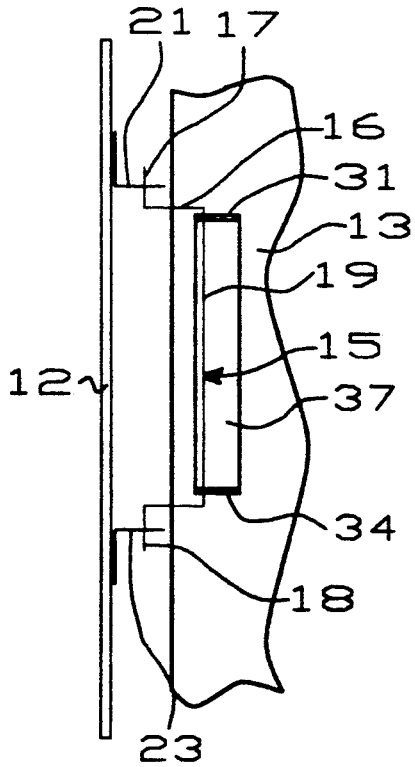

Some of these mounting clips or brackets, such as the mounting brackets 31 and 34 or mounting clips 32 and 35 for the hinge rod 16 inside of its offset end portions 17 and 18, may project from a common hinge rod mounting base 37, such as shown for the brackets 31 and 34 in FIGS. 2, 4, and in FIG. 6 which is an embodiment of the version shown in FIG. 2.

Spot welding, fasteners or any other means and methods may be used for attaching the mounting clips and brackets to the box 12 and door 13, respectively.

Figure 9:
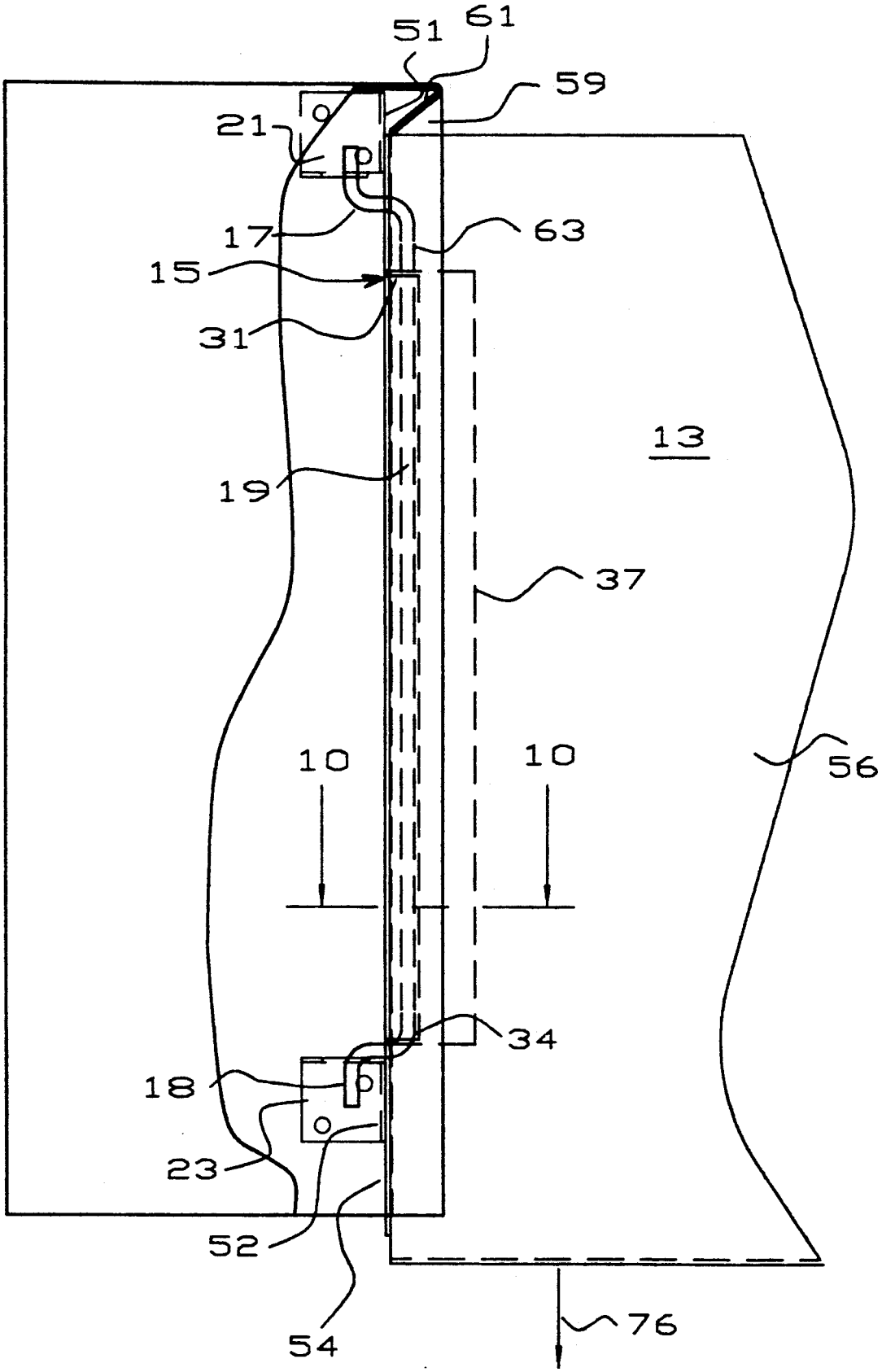
FIG. 9 is a view similar to FIG. 7, but with the cabinet door open.
Figure 11:
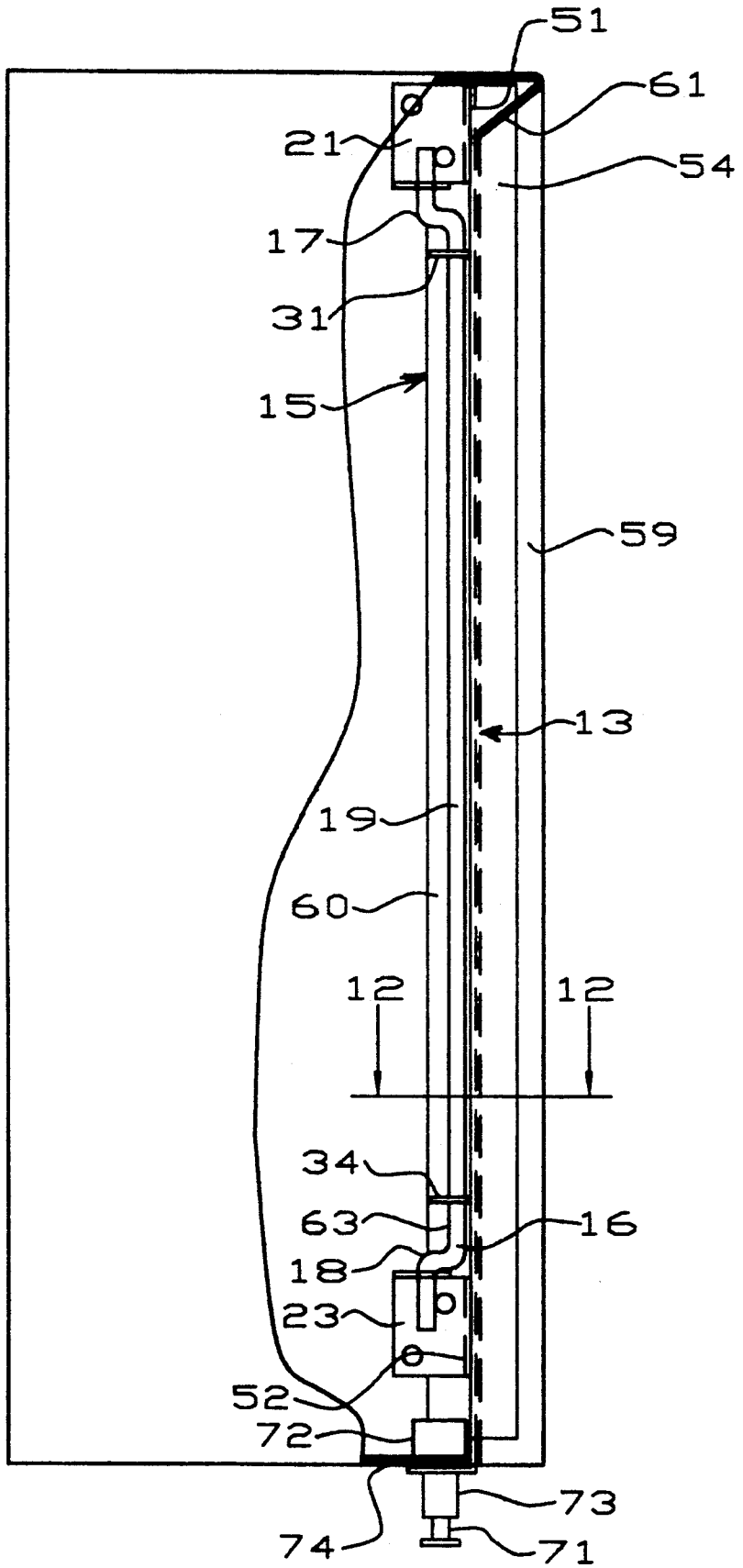
FIG. 11 is a view similar to FIG. 7, but for another embodiment of invention, similar to FIGS. 1 and 4.
Figure 13:
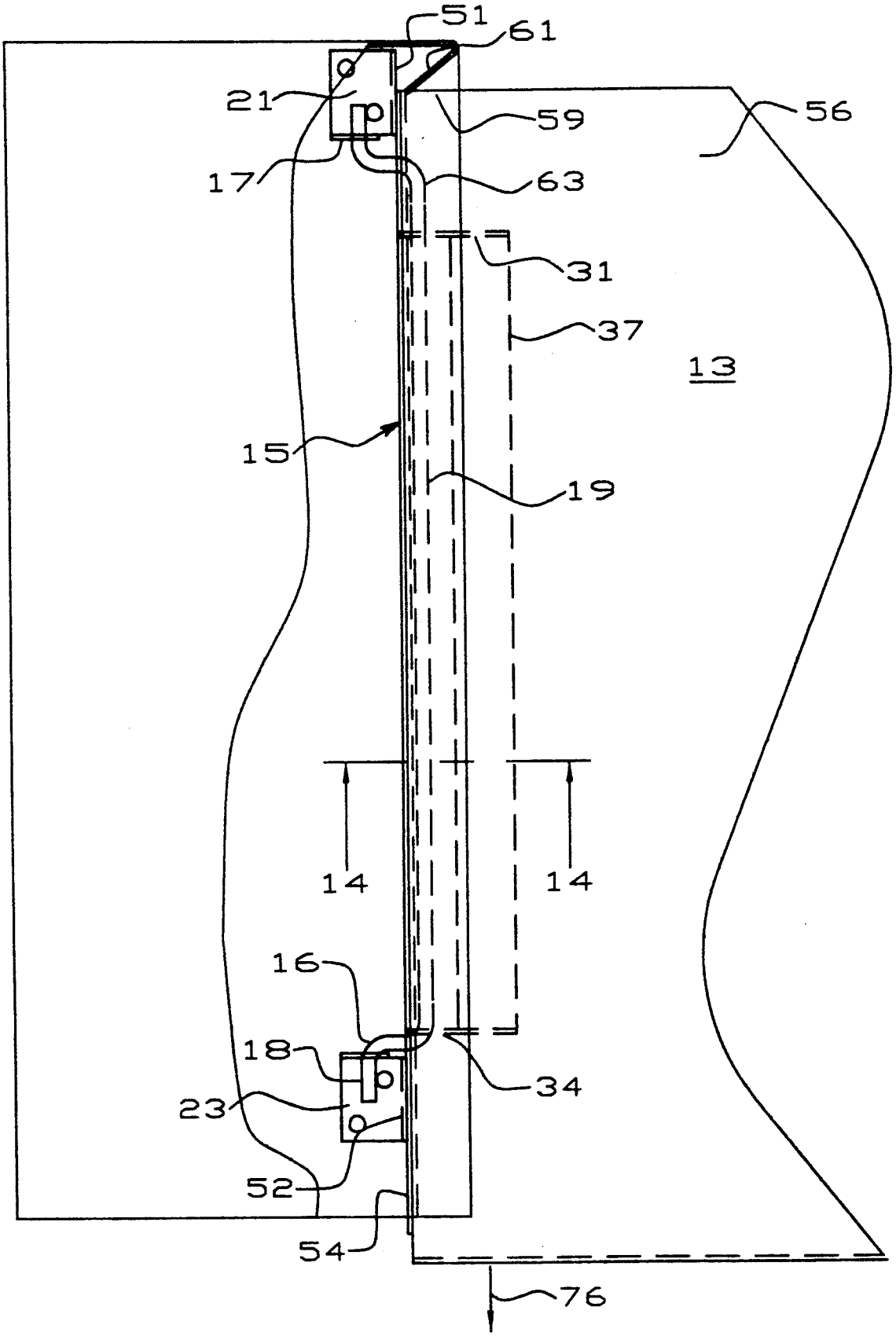
FIG. 13 is a view similar to FIG. 11, but with the cabinet door open.
Figure 12:
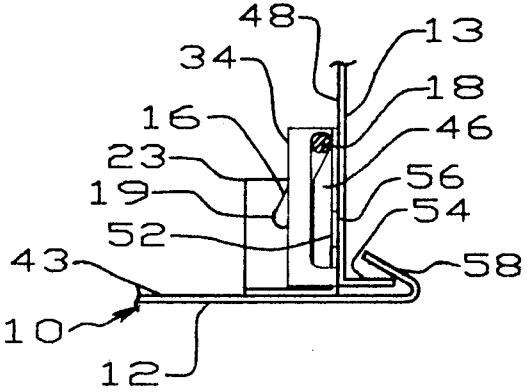
FIG. 12 is a section taken on the line 12—12 in FIG. 11.
Figure 14:
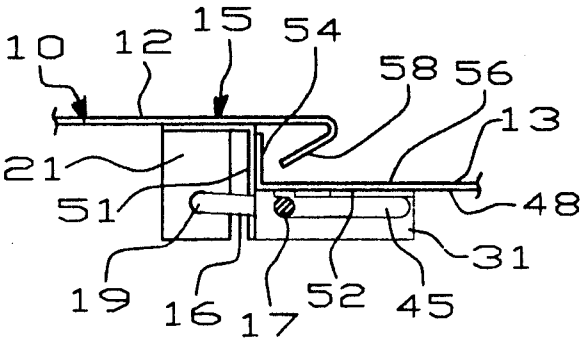
FIG. 14 a section taken on the line 14—14 in FIG. 13.
Figure 10:
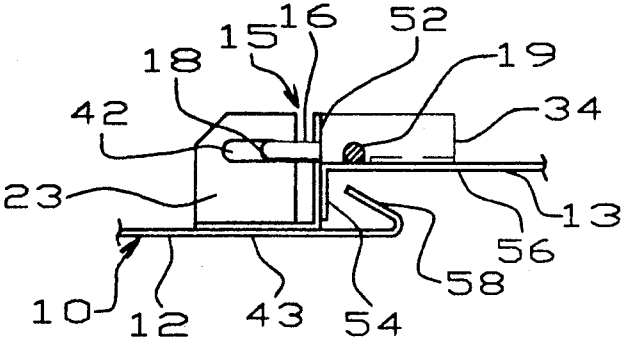
FIG. 10 is a view taken on the line 10—10 in FIG. 9.

As seen in FIG. 6, the first mounting clip 21 has a first slot 41 for accommodating the first offset rod end portion 17. Similarly, the second mounting clip 23 has a corresponding second slot 42, seen in FIG. 8, for accommodating the second offset rod end portion 18. The slots 41 and 42 may extend in parallel to a side wall 43 of the cabinet 10 or to the door 13 when open as in FIGS. 6, 9 and 10, or at right angles to the door 13 when closed as in FIGS. 7 and 8.

Figure 3:
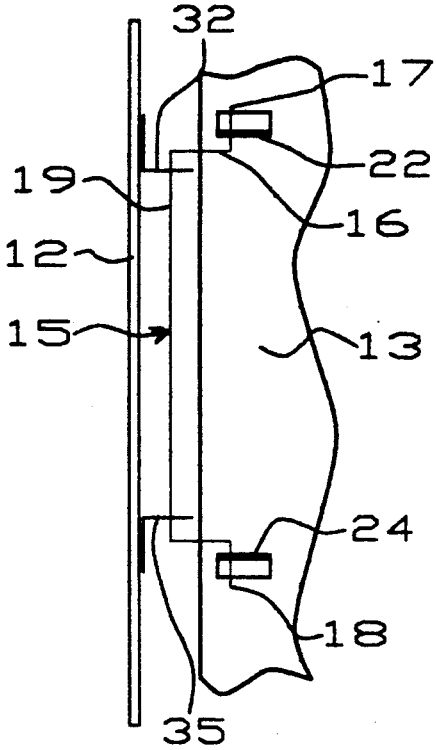

The same kind of slots 41 and 42 may be provided in the same mounting clips 21 and 23 in the embodiment of FIG. 2 or in the hinge rod mounting brackets 32 and 35 in the embodiment of FIG. 3.

As seen in FIGS. 6, 7, 9 and 11, the first mounting clip 21 is located at a first end of the opening 14, while the second mounting clip 23 is located at an opposite second end of that cabinet opening 14.

An execution of the embodiment shown in FIG. 4 is illustrated in FIGS. 11 to 14. In that case, the rod mounting brackets 31 and 34 have corresponding first and second slots 45 and 46, seen in FIGS. 12 and 14, for accommodating the offset rod end portions 17 and 18, respectively. These first and second slots 45 and 46 may extend substantially parallel to the door 13 or to an inside 48 of the door. The slots may be laterally defined by the door 13, at the inside 48.

In the case of FIGS. 4 and 11 to 14, the mounting brackets 31 and 34 are thus slotted, while the mounting clips 21 and 23 are not slotted, but merely serve as bearings for the first and second offset rod end portions 17 and 18, respectively. Conversely, in the case of FIGS. 2 and 6 to 10, the mounting clips 21 and 23 are slotted, while the mounting brackets 31 and 34 serve as bearings for the intermediate portion 19 of the hinge rod 16. In the case of FIG. 3, the mounting brackets 32 and 35 are slotted, but the mounting clips 22 and 24 are not slotted. Conversely, in the case of FIG. 5, the mounting brackets 32 and 35 are not slotted, but the mounting clips 22 and 24 are slotted.

It may thus be seen that the illustrated embodiments of the invention provide a hinge 15 with a hinge rod 16 having a first offset end portion 17 and a corresponding second offset end portion 18 opposite that first offset end portion and an intermediate portion 19 between these first and second offset end portions. These embodiments also provide a first mounting clip 21 or 22 for the first offset end portion 17 connected to one of the box 12 and the door 13 near the opening 14, such as to the box 12 in FIGS. 2, 4 and 6 to 14 or to the door 13 in FIGS. 3 and 5.

Figure 5:
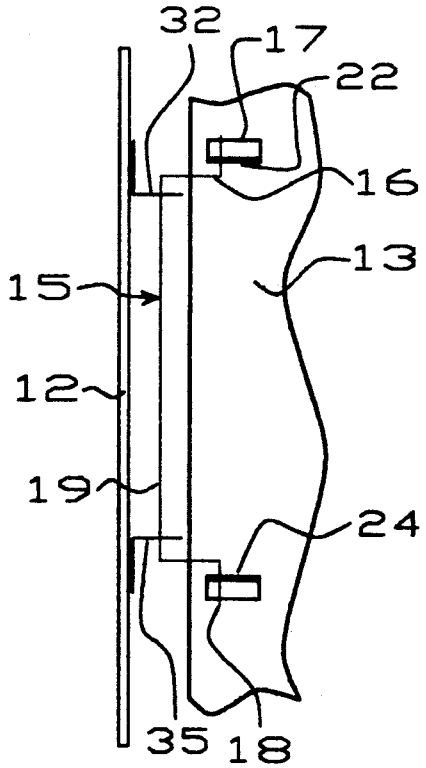

Such embodiments further provide a second mounting clip 23 or 24 for the second offset end portion 18 connected to the same one of the box 12 and the door 13 near the opening 14; that is again to the box 12 in FIGS. 2, 4, and 6 to 14, and to the door 13 in FIGS. 3 and 5.

There is further provided a first hinge rod mounting bracket 31 or 32 for the intermediate rod portion 19 inside of the first offset end portion 17 connected to the other of the box 12 and the door 13, such as to the box 12 in FIGS. 3 and 5, or to the door 13 in FIGS. 2, 4 and 6 to 14.

There further is provided a second hinge rod mounting bracket 34 or 35 for the intermediate rod portion 19 inside of the second offset end portion 18 connected to the other of the box 12 and the door 13 just mentioned. The first slot 41 or 45 for one of the first offset end portion 17 and the intermediate rod portion 19 is provided in one of the first mounting clip 21 or 22 and the first hinge rod mounting bracket 31 or 32, such as in the first mounting clip 21 or 22 in FIGS. 2 and 5 to 10, or in the first mounting bracket 31 or 32 in FIGS. 3, 4 and 11 to 14.

The corresponding second slot 42 or 46 for one of the second offset end portion 18 and the intermediate rod portion 19 is provided in the corresponding one of the second mounting clip 23 or 24 and the second hinge rod mounting bracket 34 or 35. Accordingly, in FIGS. 2 and 6 to 10 where the first slot 41 is provided in the first mounting clip 21, the second slot 42 is provided in the corresponding second mounting clip 23. The same applies to FIG. 5 where a first slot is provided in the first mounting clip 22 and a corresponding second slot in the corresponding second mounting clip 24. Conversely, if the first slot 45 is provided in the first mounting bracket 31 as in FIGS. 4 and 11 to 14, then the corresponding second slot 46 is provided in the corresponding second mounting bracket 34 (rather than in the opposite second mounting clip 23). Similarly, if a first slot is provided in the first mounting bracket 32 as in FIG. 3, then the corresponding second slot is provided in the corresponding second mounting bracket 35 (rather than in the opposite second mounting clip 24).

A preferred embodiment of the invention includes some door edge supporting bracket connected to the box 12 at its opening 14. By way of example, each of the first and second mounting clips 21 and 23 preferably has such a door edge supporting bracket 51 or 52, respectively, at the cabinet opening 14, as shown in FIGS. 6 to 14. Alternatively, in embodiments such as in FIGS. 3 and 5, each of the hinge rod mounting brackets 32 and 33 may carry a door edge supporting bracket. Preferably, there is at least one door edge supporting bracket at the cabinet opening 14.

The hinge rod mounting brackets 31 and 34 or 32 and 35 may be considered as hinge rod mounting elements of a composite hinge rod mounting bracket structure, even where they are not united by a base 37. Within the scope of the invention, there may be one mounting bracket extending along the hinge rod intermediate portion 19, and being for instance, in the form of a long clamp. In that case, what has been shown herein as first and second slots 45 and 46 may in fact be one elongate slot or opening in such a one mounting bracket or flattened clamp along the intermediate rod portion 19. However, even for such a case one end of such elongate opening facing the first mounting clip 21 is herein considered a first slot akin to the first slot 45, while the other end of that elongate opening facing the second mounting clip 23 is herein considered a second slot akin to the second slot 46.

In the embodiments of FIGS. 2 and 5 to 10, the first and second slots 41 and 42 are in the first and second mounting clips 21 and 23 or 22 and 24, respectively. In this respect, the first and second mounting clips 21 and 23 are attached to the box 12 and the hinge rod mounting bracket or brackets 31 and 34 are attached to the door 13 in the embodiment of FIGS. 2 and 6 to 10. On the other hand, the first and second mounting clips 22 and 24 are attached to the door 13 and the hinge rod mounting bracket or brackets 32 and 35 are attached to the box 12 in the embodiment of FIG. 5.

In the embodiment of FIGS. 3, 4 and 11 to 14, the first and second slots 45 and 46 are in the first and second hinge rod mounting brackets 31 and 34 or 32 and 35, respectively, or as a combined slot in a single hinge rod mounting clamp or bracket. In this respect the first and second mounting clips 21 and 23 are attached to the box 12 and the hinge rod mounting bracket or brackets 31 and 34 are attached to the door 13 in the embodiment of FIGS. 4 and 11 to 14. On the other hand, the first and second mounting clips 22 and 24 are attached to the door 13 and the hinge rod mounting bracket or brackets 32 and 35 are attached to the box 12 in the embodiment of FIG. 3.

According to the illustrated preferred embodiment of the invention, the door 13 has a ledge 54 extending away from the door panel 56 or away from the first and second mounting clips 22 and 24, or away from the mounting brackets 31 and 34. The box 12 has a bent wall portion 58 along the cabinet opening 14 extending about the door ledge 54 for weather protection and integrity. A corresponding bent wall portion 59 for the cabinet is also seen in FIGS. 7, 9, 11 and 13. In practice, this may be important for weather proofing the cabinet 10. An inwardly turned ledge 60 may serve the same kind of purpose along the outer side of the door panel 56.

The illustrated box 12 has a first bent wall portion 58 along the opening 14 extending about the door ledge 54, and a second bent wall portion 61 extending along that cabinet opening at a right angle to the first bent wall portion 58 and also to the further bent wall portion 59. That bent wall portion 61 may be seen as a downwardly projecting ledge along the cabinet opening 14 at a right angle to the longitudinal axis of the hinge rod 16 or intermediate rod portion 19.

Figure 7:
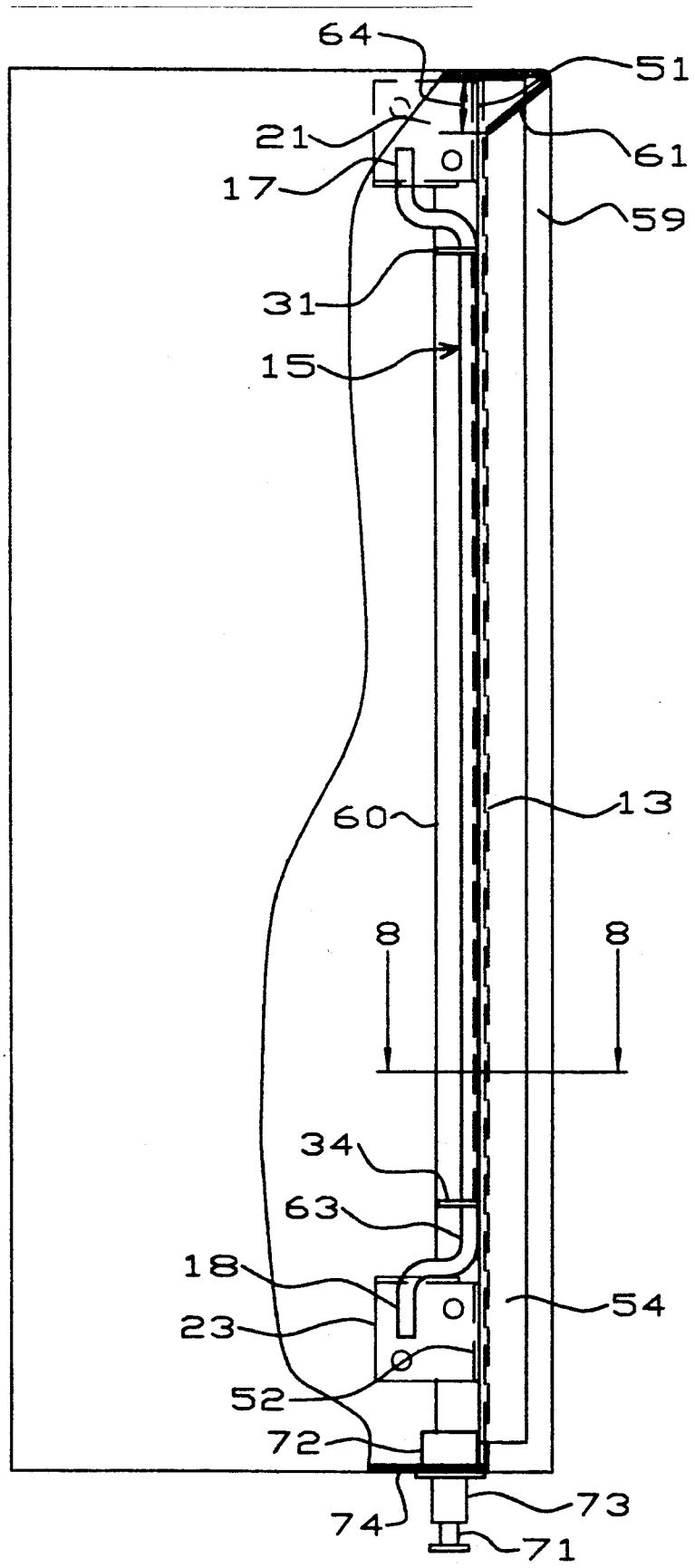
FIG. 7 is a side view, partially in section, of the cabinet of FIG. 6 with the door closed.
Figure 8:
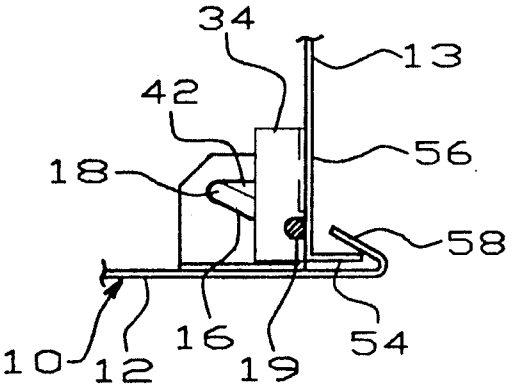
FIG. 8 is a view taken on the line 8—8 in FIG. 7.

An important embodiment of the invention provides longitudinal or vertical lost motion or play 63 at either of the first and second offset end portions 17 and 18. That preferably corresponds to a height 64 of the downwardly projecting box ledge 61 as indicated in FIG. 7. As shown in the drawings, the desired free play 63, can, for example, be provided by spacing the rod mounting brackets 31 and 34 by a distance which is less than the distance of the offset rod end portions 17 and 18 from each other at the opposite ends of the intermediate rod portion 19. Alternatively or additionally, play may be provided along the vertical or longitudinal portions or parts of at least one of the offset rod end portions 17 and 18, such as seen in FIG. 6 for the portion 17. These features are expressed herein by saying that the hinge rod 16 has a free length at either of its first and second offset end portions.

In this manner, the door 13 is selectively moveable downwardly away from the downwardly projecting box ledge 61, and is alternatively moveable upwardly and partially under that downwardly projecting ledge or overhang 61 for optimum weather protection.

The cabinet 10 includes a releasable door fastener having mating fastener parts 71 and 72 attached to the door 13 and box 12, respectively. By way of example the fastener part 71 may include a thumb screw vertically slidable and captured in a sleeve 73 attached to a bottom ledge 74 of the door 13. The thread of the thumb screw is insertable into a threaded nut 72 provided in the box to complete the above mentioned mating fastener parts. The fastener part or nut is only shown in FIG. 7 and 11 in order to avoid a crowding of other features and reference numbers and lines in other figures.

The cabinet is closed by the door 13 when the thumb screw 71 is threaded tightly into the threaded nut 72 in the box 12. In order to open the cabinet 10, the door 13 is released from the box 12 by releasing the door fastener, such as by unthreading the thumb screw 71 from the threaded hole 72 in the box. Owing to the free length or play 63 of the rod 16 or hinge 15, the released door 13 can now move downwardly, such as by the pull of gravity, as indicated by the arrow 76 and the position of the lower door edge in FIGS. 9 and 13, as compared to the position of the lower door edge in FIGS. 7 and 11, for instance. Viewed differently, the illustrated preferred embodiment of the invention provides a lost-motion connection between hinge rod and hinge clips or mounting brackets, such as at 63 at either of the offset end portions of the hinge rod.

In this or any equivalent manner, the upper edge of the door 13 can clear the lower edge of the upper box ledge or overhang 61, such as indicated by the arrow 76.

In other words, the door 13 drops vertically downward by a limited distance 64 and can now be swung open about the hinge 15. One or more of the door edge supporting brackets 51 and 52 provide in effect a pivot surface at the cabinet opening 14 about which the door can swing, both when it is opened and when it is closed again. Also, while the door 13 is open, one or more of the door edge supporting brackets 51 and 52 cooperate with the hinge structure and/or the bent-over box wall portion 58 in retaining the door against gravity.

When the door 13 is swung back to its closed position onto the cabinet opening 14, its upper edge again clears the lower edge of the upper bent-over box wall portion 61. At that point, the door 13 can be pushed upwardly contrary to the arrow 76 so that the upper margin of the door 13 moves under the cabinet box overhang 61. The fastener or thumb screw 71 can then be tightened into the threaded nut 72 in the box, so that the upper door margin is retained under the box overhang 61 for optimum weather protection, particularly in the case of rainstorms and the like.

The embodiments of the invention shown in FIGS. 1 and 6 to 14 thus provide a cabinet structure which both is weatherproof and has a hinged door that remains integral with the cabinet when the door is opened.

The subject extensive disclosure will render apparent or suggest to those skilled in the art various modifications and variations within the spirit and scope of the subject invention and equivalents thereof.

I claim:

1. In a cabinet having a box and a door in an opening of said box, the improvement comprising in combination:

a hinge rod having a first offset end portion and a corresponding second offset end portion opposite said first offset end portion and an intermediate portion between said fist and second offset end portions;

said hinge rod including said first and second offset end portions and said intermediate portion being all in one plane;

a first mounting clip for said first offset end portion connected to one of said box and said door near said opening;

a second mounting clip for said second offset end portion connected to said one of said box and said door near said opening;

a hinge rod mounting bracket for said intermediate portion connected to the other of said box and said door;

a first slot for one of said first offset end portion and said intermediate portion in one of said first mounting clip and said hinge rod mounting bracket; and a corresponding second slot for one of said second offset end portion and said intermediate portion in a corresponding one of said second mounting clip and said hinge rod mounting bracket;

said box having a downwardly projecting ledge along said opening at a right angle to said hinge rod; and said hinge rod having a free length at either of said first and second offset end portions corresponding to a height of said downwardly projecting ledge, whereby said door is selectively moveable away from said downwardly projecting ledge, and alternatively moveable upwardly and partially under said downwardly projecting ledge.

2. A cabinet as in claim 1, including:

a door edge supporting bracket connected to said box at said opening.

3. A cabinet as in claim 1, wherein:

said door has a door panel and a ledge extending away from said door panel; and said box has a bent wall portion along said opening extending about said ledge.

4. A cabinet as in claim 1, including:

a releasable door fastener having mating fastener parts attached to said door and box, respectively.

5. A cabinet as in claim 1, wherein:

said first and second slots are in said first and second mounting clips, respectively.

6. A cabinet as in claim 5, wherein:

said first and second mounting clips are attached to said box; and said hinge rod mounting bracket is attached to said door.

7. A cabinet as in claim 5, wherein:

said first and second mounting clips are attached to said door; and said hinge rod mounting bracket is attached to said box.

8. A cabinet as in claim 1, wherein:

said first and second slots are in said hinge rod mounting bracket.

9. A cabinet as in claim 8, wherein:

said first and second mounting clips are attached to said box; and said hinge rod mounting bracket is attached to said door.

10. A cabinet as in claim 8, wherein:

said first and second mounting clips are attached to said door; and said hinge rod mounting bracket is attached to said box.

11. In a cabinet having a box and a door in an opening of said box, the improvement comprising in combination:

a hinge rod having a first offset end portion and a corresponding second offset end portion opposite said first offset end portion;

said hinge rod including said first and second offset end portions and said intermediate portion being all in one plane;

a first mounting clip for said first offset end portion connected to said box near said opening and having a first slot for said first offset end portion;

a second mounting clip for said second offset end portion connected to said box near said opening and having a corresponding second slot for said second offset end portion; and a hinge rod mounting bracket inside of said first and second mounting clips connected to said door near said opening;

said box having a downwardly projecting ledge along said opening at a right angle to said hinge rod; and said hinge rod having a free length at either of said first and second offset end portions corresponding to a height of said downwardly projecting ledge, whereby said door is selectively moveable away from said downwardly projecting ledge, and alternatively moveable upwardly and partially under said downwardly projecting ledge.

12. A cabinet as in claim 11, including:

a door edge supporting bracket connected to said box at said opening.

13. A cabinet as in claim 11, wherein:

each of said first and second mounting clips has a door edge supporting bracket at said opening.

14. A cabinet as in claim 11, wherein:

said hinge rod mounting bracket includes a first hinge rod mounting element near said first mounting clip and a second hinge rod mounting element near said second mounting clip.

15. A cabinet as in claim 11, wherein:

said door has a ledge extending away from said first and second mounting clips.

16. A cabinet as in claim 15, wherein:

said box has a bent wall portion along said opening extending about said ledge.

17. A cabinet as in claim 15, wherein:

said box has a first bent wall portion along said opening extending about said ledge, and a second bent wall portion extending along said opening at a right angle to said first bent wall portion.

18. A cabinet as in claim 11, including:

a releasable door fastener having mating fastener parts attached to said door and box, respectively.

19. In a cabinet having a box and a door in an opening of said box, the improvement comprising in combination:

a hinge rod having a first offset end portion and a corresponding second offset end portion opposite said first offset end portion;

said hinge rod including said first and second offset end portions and said intermediate portion being all in one plane;

a first mounting clip for said first offset end portion connected to said box near said opening;

a second mounting clip for said second offset end portion connected to said box near said opening; and a hinge rod mounting bracket inside of said first and second mounting clips connected to said door and having a slot for said hinge rod;

said box having a downwardly projecting ledge along said opening at a right angle to said hinge rod; and said hinge rod having a free length at either of said first and second offset end portions corresponding to a height of said downwardly projecting ledge, whereby said door is selectively moveable away from said downwardly projecting ledge, and alternatively moveable upwardly and partially under said downwardly projecting ledge.

20. A cabinet as in claim 19, including:

a door edge supporting bracket connected to said cabinet at said opening.

21. A cabinet as in claim 19, wherein:

each of said first and second mounting clips has a door edge supporting bracket at said opening.

22. A cabinet as in claim 19, wherein:

said hinge rod mounting bracket includes a first hinge rod mounting element having said slot for said hinge rod near said first mounting clip and a second hinge rod mounting element having a corresponding slot for said hinge rod near said second mounting clip.

23. A cabinet as in claim 19, wherein:

said door has a ledge extending away from said first and second mounting clips.

24. A cabinet as in claim 23, wherein:

said box has a bent wall portion along said opening extending about said ledge.

25. A cabinet as in claim 23, wherein:

said box has a first bent wall portion along said opening extending about said ledge, and a second bent wall portion extending along said opening at a right angle to said first bent wall portion.

26. A cabinet as in claim 19, including:

a releasable door fastener having mating fastener parts attached to said door and box, respectively.

27. In a cabinet having a box and a door in an opening of said box, the improvement comprising in combination:

a hinge rod having a first offset end portion and a corresponding second offset end portion opposite said first offset end portion and an intermediate portion between said first and second offset end portions;

a first mounting clip for said first offset end portion connected to one of said box and said door near said opening;

a second mounting clip for said second offset end portion connected to said one of said box and said door near said opening;

a hinge rod mounting bracket for said intermediate portion connected to the other of said box and said door;

a first slot for one of said first offset end portion and said intermediate portion in one of said first mounting clip and said hinge rod mounting bracket; and a corresponding second slot for one of said second offset end portion and said intermediate portion in a corresponding one of said second mounting clip and said hinge rod mounting bracket;

said box having a downwardly projecting ledge along said opening at a right angle to said hinge rod; and said hinge rod having a free length at either of said first and second offset end portions corresponding to a height of said downwardly projecting ledge, whereby said door is selectively moveable away from said downwardly projecting ledge, and alternatively moveable upwardly and partially under said downwardly projecting ledge.

28. A cabinet as in claim 27, including:

a releasable door fastener having mating fastener parts attached to said door and box, respectively.

29. In a cabinet having a box and a door in an opening of said box, the improvement comprising in combination:

a hinge rod having a first offset end portion and a corresponding second offset end portion opposite said first offset end portion;

a first mounting clip for said first offset end portion connected to said box near said opening and having a first slot for said first offset end portion;

a second mounting clip for said second offset end portion connected to said box near said opening and having a corresponding second slot for said second offset end portion; and a hinge rod mounting bracket inside of said first and second mounting clips connected to said door near said opening;

said box having a downwardly projecting ledge along said opening at a right angle to said hinge rod; and said hinge rod having a free length at either of said first and second offset end portions corresponding to a height of said downwardly projecting ledge, whereby said door is selectively moveable away from said downwardly projecting ledge, and alternatively moveable upwardly and partially under said downwardly projecting ledge.

30. A cabinet as in claim 29, including:

a releasable door fastener having mating fastener parts attached to said door and box, respectively.

31. In a cabinet having a box and a door in an opening of said box, the improvement comprising in combination:

a hinge rod having a first offset end portion and a corresponding second offset end portion opposite said first offset end portion;

a first mounting clip for said first offset end portion connected to said box near said opening;

a second mounting clip for said second offset end portion connected to said box near said opening; and a hinge rod mounting bracket inside of said first and second mounting clips connected to said door and having a slot for said hinge rod;

said box having a downwardly projecting ledge along said opening at a right angle to said hinge rod; and said hinge rod having a free length at either of said first and second offset end portions corresponding to a height of said downwardly projecting ledge, whereby said door is selectively moveable away from said downwardly projecting ledge, and alternatively moveable upwardly and partially under said downwardly projecting ledge.

32. A cabinet as in claim 31, including:

a releasable door fastener having mating fastener parts attached to said door and box, respectively.

* * * * *